US006885144B2

(12) United States Patent
Matsuo

(10) Patent No.: US 6,885,144 B2
(45) Date of Patent: Apr. 26, 2005

(54) FLUORESCENT LAMP AND METHOD FOR MANUFACTURE, AND INFORMATION DISPLAY APPARATUS USING THE SAME

(75) Inventor: Kazuhiro Matsuo, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 103 days.

(21) Appl. No.: 10/456,701

(22) Filed: Jun. 6, 2003

(65) Prior Publication Data

US 2003/0218415 A1 Nov. 27, 2003

Related U.S. Application Data

(63) Continuation of application No. PCT/JP01/10662, filed on Dec. 6, 2001.

(30) Foreign Application Priority Data

Dec. 8, 2000 (JP) ..... 2000-374925
Jan. 25, 2001 (JP) ..... 2001-016664

(51) Int. Cl.[7] ..... H01J 1/62
(52) U.S. Cl. ..... 313/485; 313/487
(58) Field of Search ..... 313/485, 487, 313/635, 467

(56) References Cited

U.S. PATENT DOCUMENTS 5,604,396 A 2/1997 Watanabe et al.

FOREIGN PATENT DOCUMENTS

| | | |
|---|---|---|
| EP | 0 757 376 | 2/1997 |
| EP | 1 115 144 | 11/2001 |
| JP | 63-81189 | 4/1988 |
| JP | 4-226425 | 8/1992 |
| JP | 5-225955 | 9/1993 |
| JP | 7-316551 | 12/1995 |
| JP | 8-106881 | 4/1996 |
| JP | 8-129987 | 5/1996 |
| JP | 9-231944 | 9/1997 |
| JP | 10-125226 | 5/1998 |
| WO | WO 00/72356 | 11/2000 |

*Primary Examiner*—Vip Patel
(74) *Attorney, Agent, or Firm*—Merchant & Gould P.C.

(57) ABSTRACT

A fluorescent lamp has a translucent container and a phosphor layer formed on an inner surface of the translucent container, and the phosphor layer comprises phosphor particles and a metal oxide that is arranged to adhere to any of contact portions among the phosphor particles and to partially expose surfaces of the phosphor particles. According to the present invention, film strength of the phosphor layer is improved while suppressing a drastic drop in an initial flux of the fluorescent lamp and deterioration of the luminance.

23 Claims, 16 Drawing Sheets

FLUORESCENT LAMP AND METHOD FOR MANUFACTURE, AND INFORMATION DISPLAY APPARATUS USING THE SAME

This application is continuation of PCT/JP01/10662 Dec. 6, 2001.

FIELD OF THE INVENTION

The present invention relates to a fluorescent lamp and a method for manufacturing the same, and relates to an information display apparatus using the fluorescent lamp. The present invention particularly discloses a structure of a phosphor layer suitably used for a cold-cathode fluorescent lamp.

BACKGROUND OF THE INVENTION

In a typical cold-cathode fluorescent lamp, a phosphor particle film is formed on an inner surface of a translucent glass bulb having electrodes arranged at both end portions thereof. In this glass bulb, a mixture of an ionizing gas including mercury and one or two or more kinds of rare gas/gasses are filled. When a positive column discharge starts between the electrodes, the mercury in the bulb is excited and ionized, and ultraviolet rays of 185 nm and 254 nm as resonance lines generated due to the mercury excitation are converted into visible light by phosphors on the inner surface of the bulb.

In a recent trend, the lamp current in a cold-cathode fluorescent lamp as a backlight source for a liquid crystal display has been increased due to decrease in tube diameter for providing a thinner liquid crystal display and also for raising the luminance of the liquid crystal display. The decrease in the tube diameter and the raised current will increase the rate of radiation of an ultraviolet ray having a wavelength of 185 nm. The increase of radiation rate of the resonance line at the short-wavelength side will increase a rate of deterioration of luminance of a fluorescent lamp over lighting time.

Factors that lower the luminance can be classified into three categories. A first factor is the coloring of glass. In most cases, this results from solarization due to the ultraviolet rays generated by a low-pressure vapor discharge of mercury and also due to collision of mercury ions. For suppressing the coloring of glass, it is proposed and practiced to form a base protective film made of $Al_2O_3$ fine particles or the like between a phosphor layer and a glass bulb in order to suppress irradiation of the glass bulb with ultraviolet rays.

However, degradation of the phosphor, which is a second factor of deterioration of luminance, cannot be suppressed only by covering the glass bulb surface with the base protective layer. Degradation of the phosphor is accelerated by irradiating with the above-described resonance line at the short-wavelength side (an ultraviolet ray having a wavelength of 185 nm). JP-07(1995)-316551 A proposes suppressing degradation of a phosphor by covering surfaces of the phosphor particles with a continuous coating layer. The reference discloses phosphor particles covered with a continuous coating layer by a sol-gel method using a solution of metalalkoxide. The phosphor particles are supplied onto the inner surface of the glass bulb after a coating of the particle surfaces. Ion impact to the phosphor can be eased by forming a phosphor layer in this manner.

However, the initial flux will be reduced remarkably when the entire phosphor surfaces are coated. Moreover, the intrusion of mercury into gaps among the phosphor particles cannot be suppressed by only forming a uniform coating film on each of the phosphor surfaces. A large amount of mercury exists in the glass bulb due to ambipolar diffusion. The ambipolar diffusion is a phenomenon in which mercury ions re-bind to electrons to be neutralized electrically. The mercury enters inside the phosphor layer and is physically adsorbed in the surfaces of the phosphor particles or the like, or they form compounds such as mercury oxide and amalgam and then are consumed.

Reduction of luminous efficiency due to the mercury consumption will result in a third factor to lower the luminance. It is known that mercury is consumed by forming amalgam with sodium. For suppressing consumption of the mercury, reduction of the sodium content in a glass bulb is proposed. However, the consumption of mercury cannot be suppressed even by adjusting the composition of the glass bulb. The consumption of mercury is accelerated when $Al_2O_3$ fine particles are blended in the phosphor layer to increase the film strength. Probably, this is caused by a large specific surface area of the $Al_2O_3$ fine particles.

Though measures for the respective factors that lower the luminance have been proposed as described above, these measures are not so sufficient when considering the above-described three factors comprehensively. The above-described measures can even degrade other properties such as the initial flux. Moreover, the conventional measures cannot improve the film strength while suppressing deterioration of the luminance.

SUMMARY OF THE INVENTION

A fluorescent lamp according to the present invention includes a translucent container and a phosphor layer formed on an inner surface of the translucent container, wherein the phosphor layer includes phosphor particles and a metal oxide that is arranged to adhere to any of contact portions among the phosphor particles and to partially expose surfaces of the phosphor particles.

In the fluorescent lamp according to the present invention, gaps among the phosphor particles are decreased due to the metal oxide. Because of the decrease in the gaps, ultraviolet rays (especially an ultraviolet ray having a wavelength of 185 nm) and mercury that reach inside the phosphor layer or the surface of the glass bulb can be reduced. This can suppress any of coloring of the glass bulb, degradation of the phosphor, and consumption of mercury. Since the whole surfaces of the phosphor particles are not coated with the metal oxide, the initial flux will not drop drastically.

A method for manufacturing a fluorescent lamp according to the present invention includes a step of coating on an inner surface of a translucent container a phosphor-layer-forming solution in which phosphor particles are dispersed and a metal compound is dissolved, and a step of heating the translucent container with the solution so as to form a metal oxide from the metal compound, thus forming a phosphor layer including the metal oxide and the phosphor particles.

The method of the present invention can provide effectively and efficiently a fluorescent lamp that has a phosphor layer including phosphor particles and a metal oxide that is formed among these phosphor particles and adheres to any of the contact portions among the particles and to partially expose the surfaces of the phosphor particles.

The present invention provides also an information display apparatus including the fluorescent lamp.

BRIEF DESCRIPTION OF THE DRAWINGS

FIG. 14(*a*) shows the property for a case with an air supply (air flow), and FIG. 14(*b*) shows the property for a case without an air supply.

DETAILED DESCRIPTION OF THE INVENTION

Figure 1:
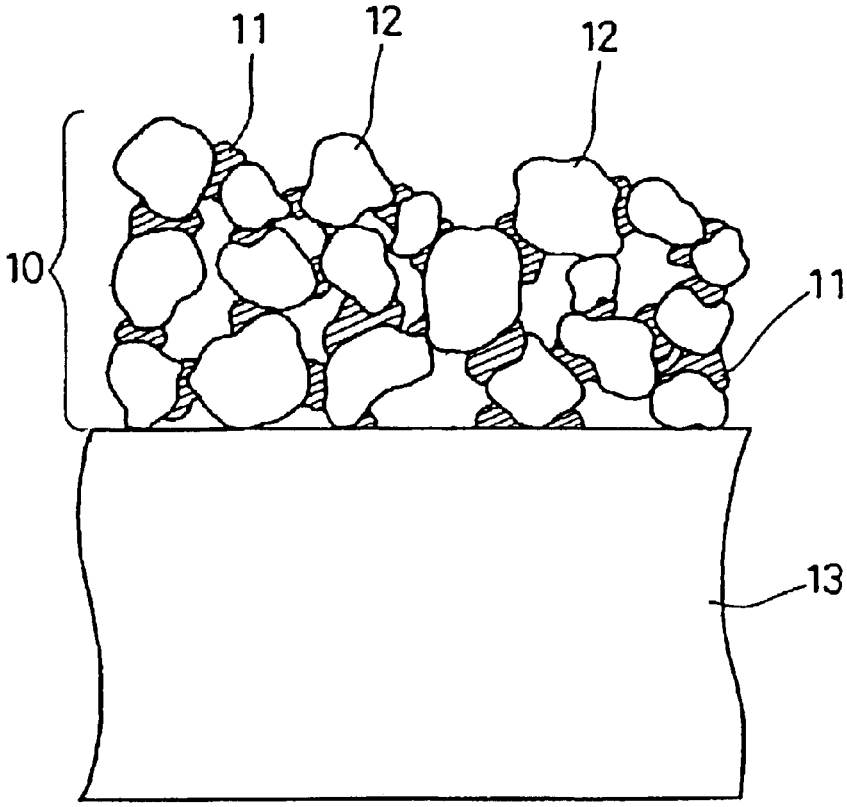
FIG. 1 is a partial cross-sectional view showing one embodiment of a fluorescent lamp according to the present invention.

Preferred embodiments of the present invention will be described below.

It is preferable for a fluorescent lamp of the present invention that a metal oxide covers 1% to 70%, or further preferably 5% to 25% of surfaces of the phosphor particles.

In a fluorescent lamp according to the present invention, the strength of the phosphor film can be improved due to a metal oxide that exists among the phosphor particles and fixes the phosphor particles, even when the phosphor layer is substantially free of non-phosphor particles that are at most 0.5 μm in particle diameter. Exclusion of the above-mentioned non-phosphor particles having a large specific surface area (e.g., $Al_2O_3$ fine particles) is preferred also from a viewpoint of suppressing consumption of mercury. Generally speaking, 'substantially free' means a content of at most 0.1 wt %.

Specifically, the metal oxide preferably contains at least one element selected from the group consisting of Y, La, Hf, Mg, Si, Al, P, B, V and Zr. Particularly preferred metals are Y and La.

It is preferable that the metal oxide contains a metal having more than $10.7\times10^{-9}$ J for a bond energy to an oxygen atom. This energy of $10.7\times10^{-9}$ J corresponds to a photon energy that an ultraviolet ray with a wavelength of 185 nm has. Therefore, the durability of the metal oxide against irradiation with an ultraviolet ray having a wavelength of 185 nm can be improved by using a metal having a greater bond energy to an oxygen atom than the photon energy.

It is preferable in the manufacturing method according to the present invention that before heating the translucent container, at least a part of a solvent contained in a phosphor-layer-forming solution coated on an inner surface of a translucent container is evaporated to be concentrated at contact portions of the phosphor particles, and more preferably, the metal compound is precipitated on the contact portions. The phosphor-layer-forming solution tends to remain in the vicinity of the contact portions among adjacent phosphor particles. Therefore, evaporating at least part of the solvent contained in the solution after the coating can ensure that the metal oxide is formed to adhere to the contact portions among the phosphor particles and partially cover surfaces of the phosphor particles.

It is preferable in the manufacturing method according to the present invention that an oxygen-containing gas is supplied to the interior of the translucent container when heating the translucent container. When a metal compound is added to the phosphor-layer-forming solution, a binder component (e.g., cellulose nitrate) contained in this solution cannot be fired sufficiently, and thus carbon tends to remain in the phosphor layer. The residual carbon will degrade the initial luminance and the luminance maintenance factor. Though the residual carbon can be prevented by raising the heating temperature, heating alone may soften and deform the translucent container (e.g., a glass bulb). Therefore, it is preferable that oxidation of the organic components is accelerated by forcibly supplying the oxygen-containing gas. The oxygen-containing gas can be selected from air, oxygen and the like. The preferred amount of air supply is at least 100 ml/minute for 1 g of a phosphor layer.

The method of supplying an oxygen-containing gas is particularly preferred in a case where oxygen is difficult to supply into a container, i.e., the translucent container is a glass tube having an inner diameter from 1.0 mm to 4 mm.

Though the metal compound can be an inorganic metal compound, an organic metal compound is preferred. A compound containing at least one group selected from the group consisting of a carboxyl group and an alkoxyl group is suitable. Though the solvent contained in the phosphor-layer-forming solution can be an organic solvent, the use of water can improve safety and working conditions during formation of the phosphor layer. For water, a water-soluble metal compound can be selected. Such a water-soluble metal compound can be selected suitably from carboxylates, specifically acetates such as yttrium acetate.

Depending on the organic metal compounds, moisture adhering to the metal oxide may cause insufficient firing of the binder. This moisture will degrade the initial luminance and the luminance maintenance factor. The moisture is considered to remain since the metal atoms (such as Y) are attacked by an OH group during a hydrolysis reaction of the metal compound. When an organic functional group bonding to the metal atom can exhibit sufficient action of steric hindrance against the OH group, a reaction between the metal atom and the OH group and a formation of a bond between the metal atom and the OH group, e.g., a formation of a Y—OH bond, can be suppressed. However, an excessively large molecular weight of the functional group can hinder the course of a thermal decomposition reaction. A study of the inventors shows that the molecular weight of the functional group is preferably from 73 to 185.

It is preferable that the phosphor-layer-forming solution contains the metal compound in a range from 1 wt % to 15 wt %, especially from 1 wt % to 2 wt % in terms of metal oxide with respect to phosphor particles. A metal compound contained in an excessively small amount cannot suppress deterioration of luminance sufficiently. On the other hand, the luminance may deteriorate when the amount of the metal compound is too large.

It is preferable that the phosphor-layer-forming solution is substantially free of non-phosphor particles that are at most 0.5 $\mu$m in particle diameter. As mentioned above, the expression of 'substantially free' generally means a range in which a content in the phosphor layer is at most 0.1 wt %.

Embodiments of the present invention will be explained further below by referring to the attached drawings.

Figure 2:
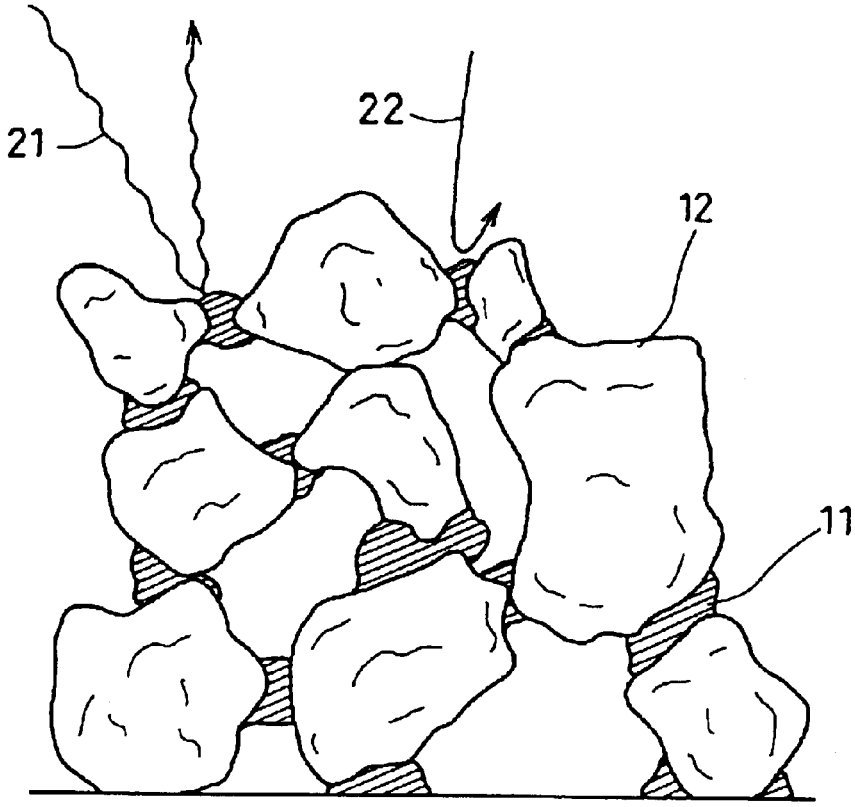
FIG. 2 is a partial enlarged view of FIG. 1.

FIG. 1 is a partial cross-sectional view showing a portion in the vicinity of a phosphor layer in one embodiment of a fluorescent lamp according to the present invention. FIG. 2 is a partial enlarged view of FIG. 1. A phosphor layer 10 is formed by stacking phosphor particles 12 on a glass bulb 13. Surfaces of the phosphor particles are partially covered with a metal oxide 11.

The metal oxide 11 adheres to contact portions of the phosphor particles and decreases the gaps in the phosphor layer. Since the gaps among the phosphor particles are decreased, an ultraviolet ray 21 and mercury 22 reaching the surface of the glass bulb 13 are decreased. This will suppress solarization of the glass bulb and amalgamation of mercury and sodium that is contained in the glass bulb. The metal oxide present on the surface layer of the phosphor layer decreases intrusion of the ultraviolet ray 21 and the mercury 22 into the phosphor layer. Accordingly, degradation of the phosphor layer and mercury consumption in the phosphor layer, which are caused by the ultraviolet ray, are suppressed as well.

The metal oxide 11 is concentrated in the vicinity of contact portions (typically contact points) where adjacent phosphor particles 12 are in contact with each other. Since the phosphor layer is composed of stacked phosphor particles, an ultraviolet ray and mercury most easily pass through the phosphor layer in the vicinity of the contact portions between the phosphor particles. Therefore, a maximum effect is obtainable in suppressing luminance deterioration when the metal oxide is concentrated at the contact portions.

Due to the metal oxide formed to adhere in the vicinity of contact portions among the phosphor particles and to increase the apparent thickness of the contact portions, the phosphor layer formed by accumulating the phosphor particles has improved strength when compared to a phosphor layer where the metal oxide is not present. Conventionally, the addition of $Al_2O_3$ fine particles is required for increasing the film strength of the phosphor layer. In contrast, this phosphor layer can improve the film strength without addition of non-fluorescent fine particles that accelerate mercury consumption and thus are unfavored from the viewpoint of luminance maintenance.

The metal oxide 11 partially covers the surfaces of the phosphor particles (i.e., at least some regions on the surfaces of the phosphor particles are exposed). Therefore, unlike a case where the entire surface of each phosphor particle is covered, radiation from the phosphor particles is not hindered extremely. When the rate of coverage of the phosphor particles is too high, the initial flux deteriorates and firing requires more energy. When the rate of coverage is too low, the effects in suppressing luminance deterioration may be insufficient. According to the study performed by the inventors, a preferable rate of coverage of the phosphor particles with the metal oxide is from 1% to 70%, particularly from 5% to 25%.

Preferably, the metal oxide 11 has a bond energy to an oxygen atom that exceeds the photon energy of an ultraviolet ray with a wavelength of 185 nm ($10.7\times10^{-9}$ J). Examples of metals that can provide such a metal oxide include Zr, Y, Hf, and the like. On the other hand, metals such as V, Al or Si have a bond energy to an oxygen atom of not more than $10.7\times10^{-9}$ J.

For the phosphors 12, conventionally-used materials (such as three-color wavelength type phosphors and halo phosphate phosphors) can be used without any specific limitations. Similarly, conventional glass can be used for the glass bulb 13, although there is no specific limitation about the glass composition.

Figure 13:
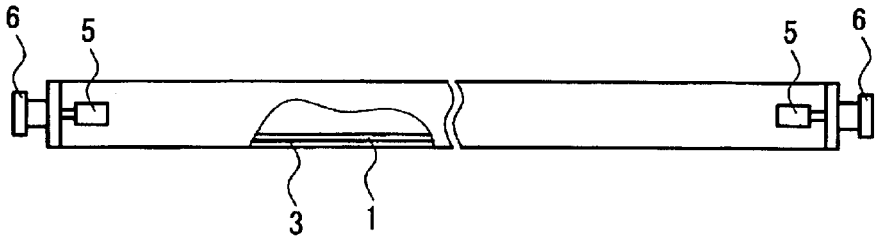
FIG. 13 is a partially-sectional plan view showing one embodiment of a fluorescent lamp according to the present invention.

FIG. 13 is a partially-sectional plan view of a cold-cathode fluorescent lamp to which the present invention is applicable. Electrodes 5 are arranged at the both end portions of this straight tube type lamp, and a phosphor layer 1 is formed on an inner surface of a bulb 3. To the electrodes 5, voltage is applied through metal plates 6.

Figure 22:
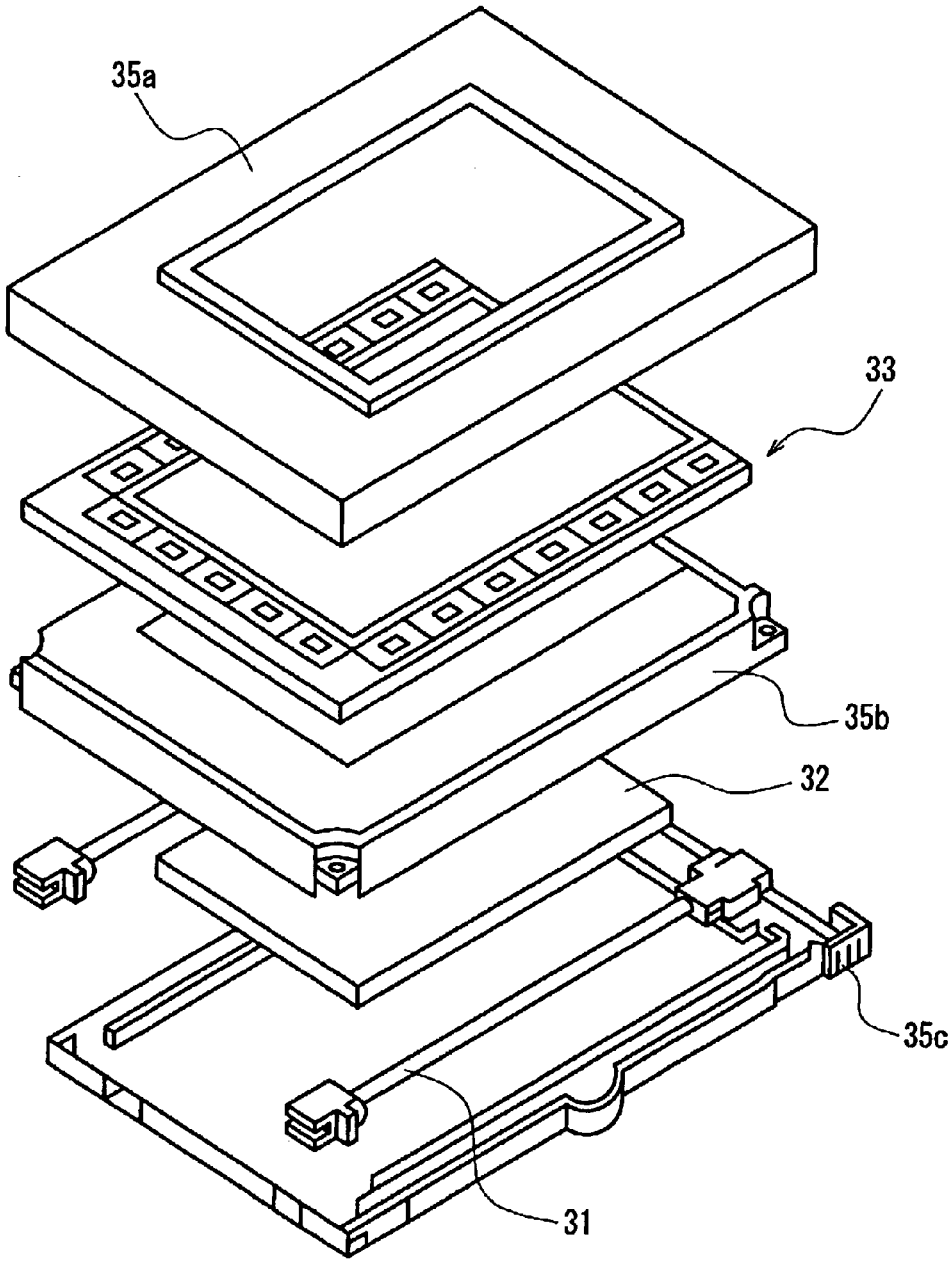
FIG. 22 is an exploded perspective view showing an embodiment of an information display apparatus according to the present invention.

FIG. 22 shows a structure of a liquid crystal display as one example of an information display apparatus according to the present invention. A cold-cathode fluorescent lamp 31 is arranged together with a light diffusion plate 32 and a liquid crystal panel 33 in frames 35*a*, 35*b* and 35*c*.

Figure 3:
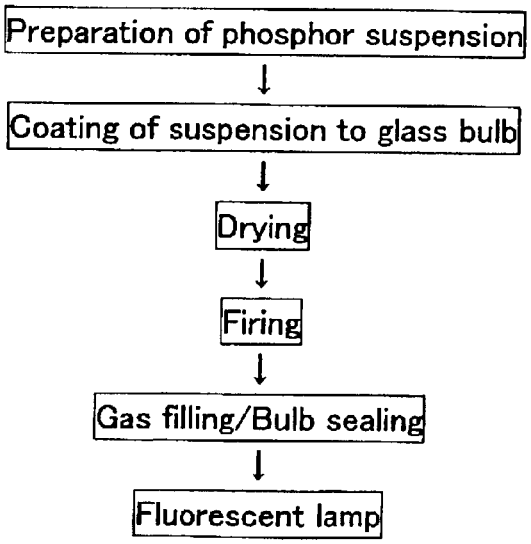
FIG. 3 is a flow chart showing one example of a method for manufacturing a fluorescent lamp according to the present invention.

A method of manufacturing a phosphor layer is exemplified below referring to FIG. 3.

First, a phosphor suspension is prepared. The phosphor suspension can be prepared by introducing a metal compound into a suspension in which a predetermined amount of phosphor particles are dispersed, where this metal compound is soluble in the suspension. This suspension thereby contains the phosphor particles as a dispersoid and the metal compound as a solute. A liquid as a dispersion medium for the dispersoid and also as a solvent for the solute can be an organic solvent (such as butyl acetate, ethanol, and methanol) or an inorganic solvent (water). Furthermore, the suspension can include a binder or the like.

Next, the phosphor suspension is supplied onto an inner surface of a glass bulb and dried. During this drying step, concentration of the metal compound is increased (i.e., the solution of the metal compound is concentrated) as the liquid dissolving the metal compound is evaporated, and thus the metal compound is precipitated among the phosphor particles. Due to the surface tension, the solution enters narrower gaps among the phosphor particles with a progress of the evaporation. As a result, the metal compound is precipitated to be concentrated at narrower gaps among the phosphor particles. Accordingly, the metal compound is precipitated typically in the vicinity of any of contact portions between adjacent phosphor particles.

In the drying step, the glass bulb is held preferably at a temperature that the liquid as a solvent of the metal compound is evaporated easily. While this temperature can be determined appropriately corresponding to the liquid in use, preferably it is from 25° C. to the boiling point of the liquid. For the case of butyl acetate, it is suitably from 25° C. to 50° C., and it is from 50° C. to 80° C. for water.

Successively, the layer formed by coating the phosphor suspension is fired. Firing can be carried out under usual conditions. The firing temperature can be about from 580° C. to 780° C. when determined as the temperatures measured in the glass bulb. During the firing step, the metal compound is decomposed and oxidized to form a metal oxide. In the thus formed phosphor layer, as shown in FIGS. 1 and 2, the metal oxide exists unevenly to adhere so as to circumferences of contact portions among the particles and thicken the contact portions by partially covering the phosphor particles.

Subsequently, a fluorescent lamp can be obtained through usual steps of exhausting of the glass bulb, filling of mercury and an ionizing gas that includes a rare gas, sealing of the bulb, and the like.

Preferably, the metal compound is dissolved in a suspension, and it is also decomposed by heat and oxidized when firing. For example, a water-soluble compound for yttrium can be selected from yttrium acetate, yttrium nitrate, yttrium sulfate, yttrium chloride, and yttrium iodide. Among these compounds, yttrium acetate is thermally decomposed at a relatively low temperature (650° C. or less).

Figure 4A:
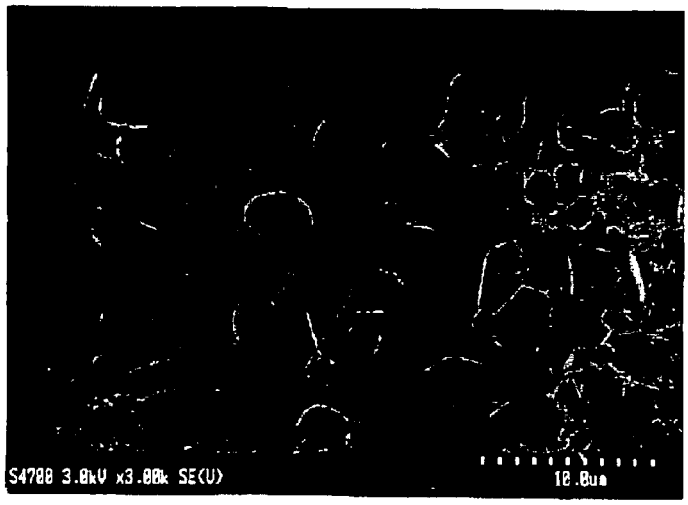
FIG. 4 shows a phosphor layer of one embodiment of a fluorescent lamp according to the present invention as observed with a HRSEM (high resolution scanning electron microscope). The entire scale of FIG. 4(*a*) is equal to 10.0 μm, and the entire scale of FIG. 4(*b*) is equal to 5.00 μm.
Figure 4B:
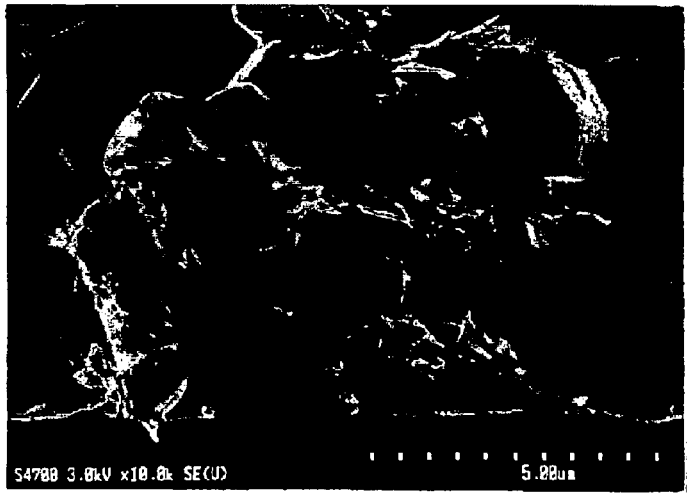
Figure 5A:
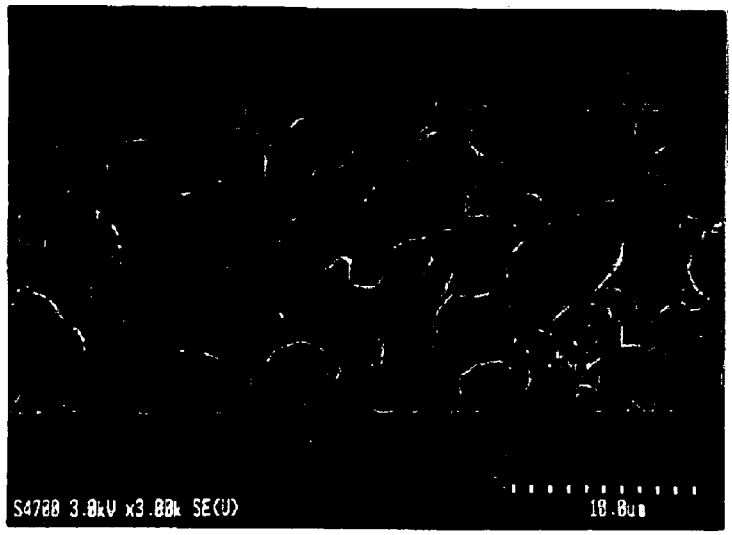
FIG. 5 shows a phosphor layer of a conventional fluorescent lamp as observed with a HRSEM. The entire scale of FIG. 5(*a*) is equal to 10.0 μm, and the entire scale of FIG. 5(*b*) is equal to 5.00 μm.
Figure 5B:
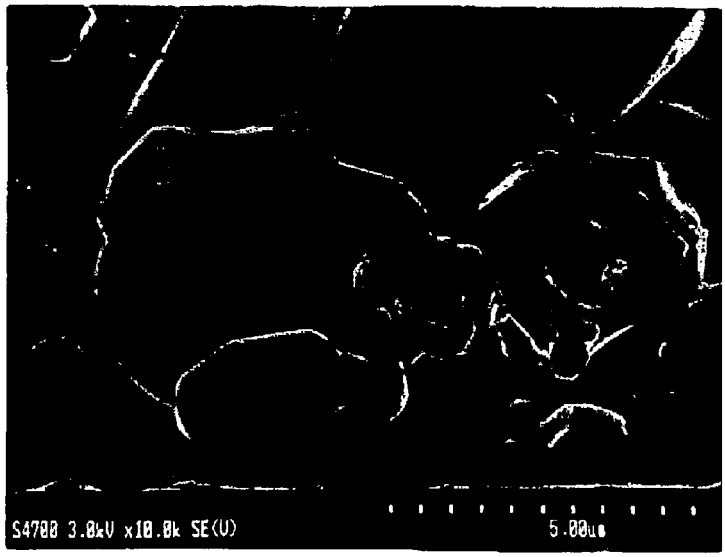

FIGS. 4A–B show a cross section of a phosphor layer formed similarly to the above-described method, which is a result of an observation using HRSEM (high resolution scanning electron microscope). When this phosphor layer is formed without adding any metal oxides, it has cross sections as shown in FIGS. 5A–B. It can be confirmed that the metal oxide provides firm connection among phosphor particles and decreases gaps in the particles.

Figure 6:
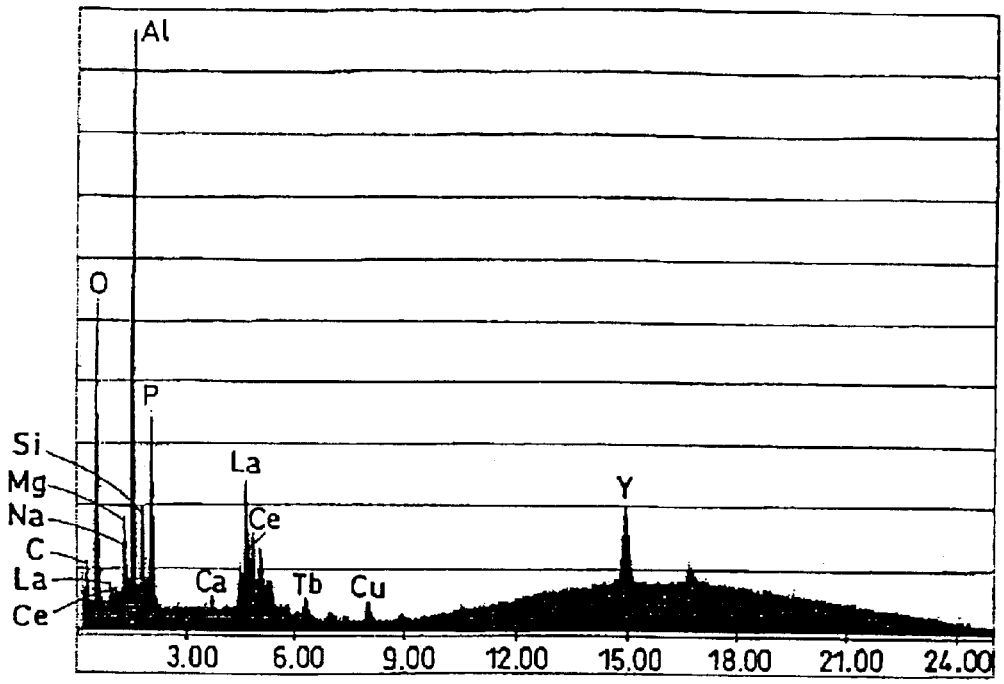
FIG. 6 shows an analytical result for a metal oxide existing among phosphor particles in one embodiment of a fluorescent lamp according to the present invention, wherein the analysis is carried out using a X-ray microanalyzer.
Figure 7:
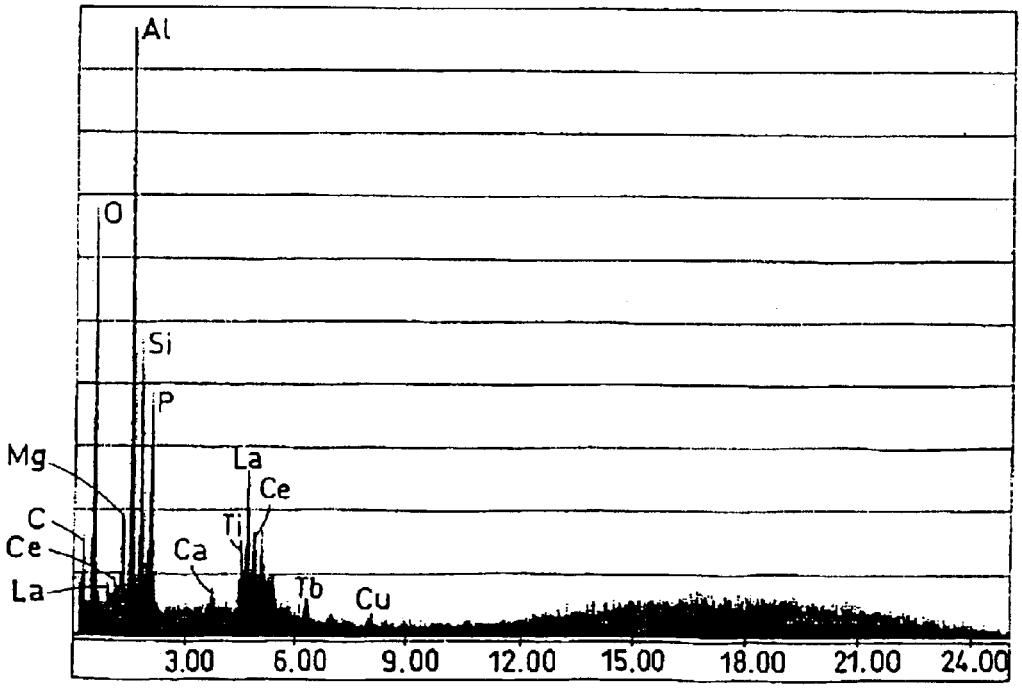
FIG. 7 shows the result of analyzing surfaces of phosphor particles in one embodiment of a fluorescent lamp according to the present invention, wherein the analysis is carried out using a X-ray microanalyzer.

Furthermore, a phosphor layer formed similarly to the above-described method was subject to a composition analysis in micro-regions by an X-ray microanalyzer. Here, a phosphor containing no yttrium was used and yttrium oxide was formed among the phosphor particles. FIG. 6 shows a result of analysis of bonding portions of the phosphor particles, and FIG. 7 shows a result of analysis of phosphor particle surfaces. Yttrium was detected only at the bonding portions of the phosphor particles.

EXAMPLES

The present invention will be described in detail by referring to Examples, though the present invention is not limited by the Examples.

Example 1

For a three-color wavelength type phosphor, YOX ($Y_2O_3$:Eu), SCA ($(SrCaBa)_5(PO_4)_3Cl$:Eu), and LAP ($LaPO_4$:Ce, Tb) were prepared. This three-color wavelength type phosphor (98.5 g) was dispersed in a solution of butyl acetate in which 1% of NC (cellulose nitrate) was dissolved previously. To this suspension, yttrium oxalate was added to be 1.5 wt % in terms of oxide concentration with respect to the phosphor particles and dissolved by stirring.

Next, the phosphor suspension was coated onto an inner surface of a glass bulb 2.6 mm in tube diameter and 300 mm in length. The coating on the glass bulb was carried out by boosting the solution upwards.

Subsequently, a layer formed by the coating was dried with hot air of 50° C. The drying time was about 3 minutes. Further, firing was carried out in a gas furnace with a temperature set at 780° C. The firing time was 3 minutes. At this time, a temperature measured in the glass bulb reached 750° C. Later, exhaustion from the glass bulb, filling of a gas (Ne:Ar=5:95; about 0.01 MPa), and sealing of the bulb were carried out to form a cold-cathode fluorescent lamp (a).

In an observation using HRSEM, about 20% of the surfaces of the phosphor particles of the fluorescent lamp (a) was covered with yttrium oxide.

Comparative Example 1

For comparison, a fluorescent lamp (b) was manufactured in the same manner as described in Example 1 except that yttrium oxalate was not added to the phosphor suspension.

Figure 8:
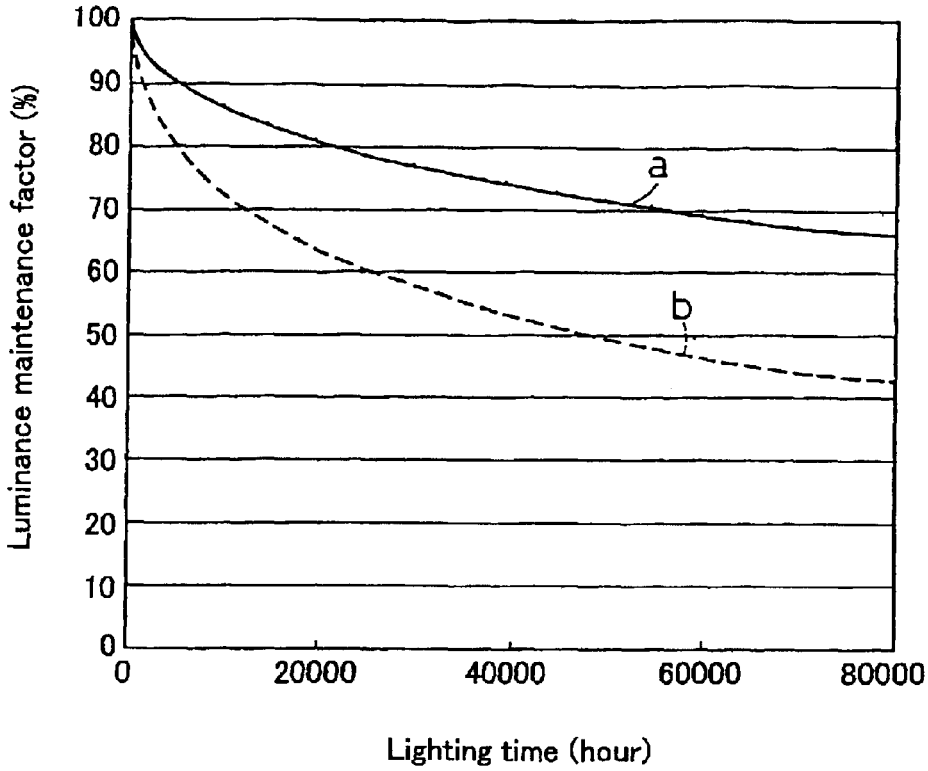
FIG. 8 shows luminous maintenance factors for a fluorescent lamp 'a' according to the present invention and for a conventional fluorescent lamp 'b'.
Figure 9:
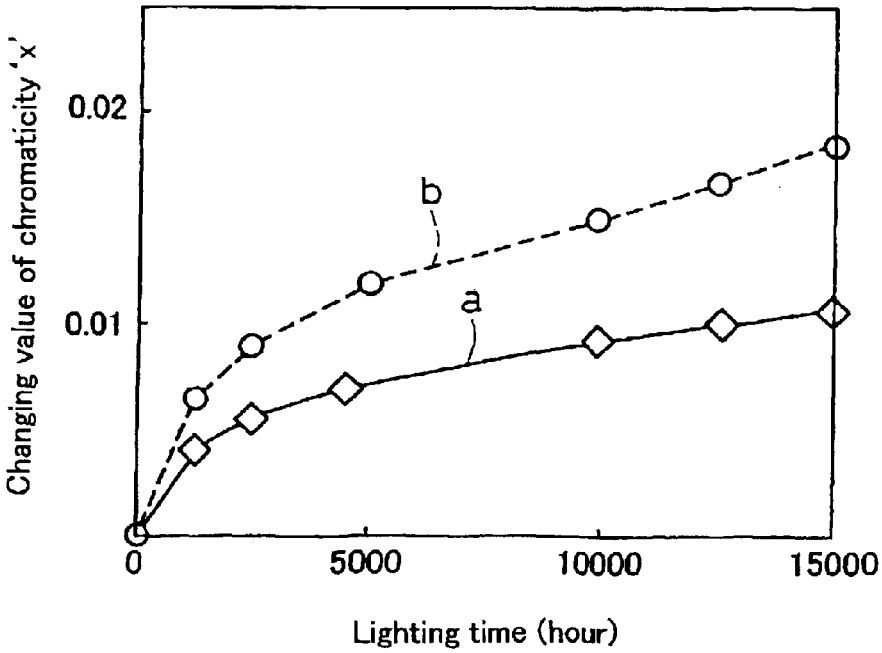
FIG. 9 shows changing values of chromaticity 'x' for a fluorescent lamp 'a' according to the present invention and for a conventional fluorescent lamp 'b'.
Figure 10:
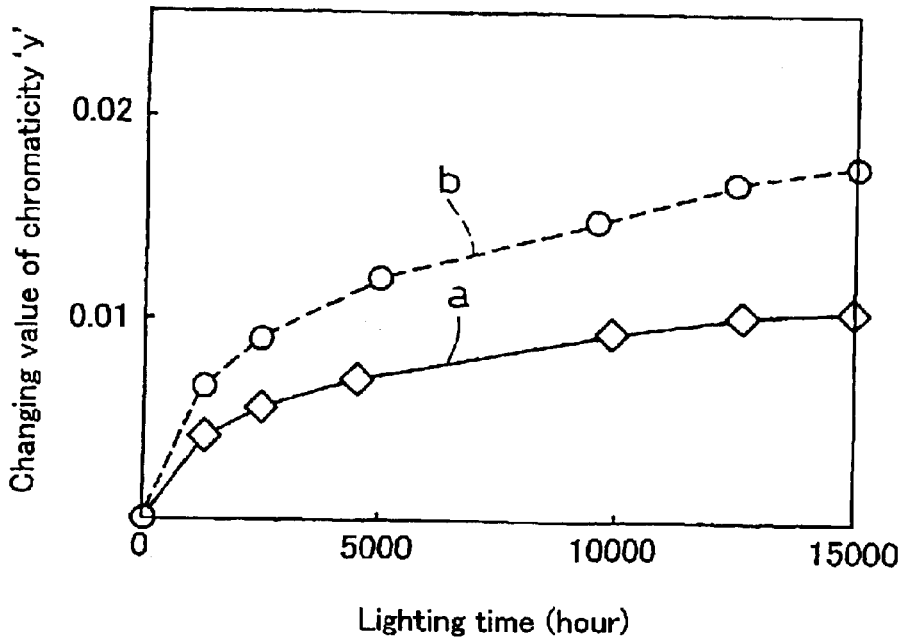
FIG. 10 shows changing values of chromaticity 'y' for a fluorescent lamp 'a' according to the present invention and for a conventional fluorescent lamp 'b'.

Luminance maintenance factors were measured for the fluorescent lamp (a) obtained in Example 1 and the fluorescent lamp (b) obtained in Comparative Example 1. The results are shown in FIG. 8. The lighting frequency and the lamp current were fixed at 35 kHz and 6 mA, respectively. Furthermore, changes in chromaticities 'x' and 'y' over time were measured. The lighting frequency and the lamp current were as described above. The results are shown in FIGS. 9 and 10 respectively. It was confirmed from FIGS. 8–10 that deterioration of luminance and changes in chromaticities 'x' and 'y' were suppressed further in the fluorescent lamp (a) having yttrium oxide formed among the phosphor particles than in the fluorescent lamp (b).

Example 2

A fluorescent lamp (c) was manufactured in the same manner as described in Example 1 except that a glass bulb was 20 mm in tube diameter and 600 mm in length and that the temperature and the firing time respectively were set at 750° C., 2 minutes. The temperature measured in the glass bulb reached 650° C.

Comparative Example 2

For a comparison, a fluorescent lamp (d) was manufactured in the same manner as described in Example 2 except that yttrium oxalate was not added to the phosphor suspension.

The film strength of the phosphor layers was evaluated for the fluorescent lamp (c) obtained in Example 2 and the fluorescent lamp (d) obtained in Comparative Example 2. The evaluation of the film strength was performed by blowing air to the phosphor layers from an air-nozzle having a tube diameter of about 1 mm. Air pressures at the time that the layers were peeled were about 0.15 MPa for the fluorescent lamp (c) and about 0.02 MPa for the fluorescent lamp (d), demonstrating that the film strength differs considerably depending on the presence of a metal oxide.

Example 3

In this example, water was used as a dispersion medium (a solvent for a metal oxide) for phosphor particles. When compared to a case using an organic solvent, the use of water can improve drastically working conditions and security in sites for manufacturing the fluorescent lamps.

In this example, YOX, SCA, and LAP were used for a three-color wavelength type phosphor. This three-color wavelength type phosphor (98.5 g) was dispersed in an aqueous solution in which 1% of PEO (polyethylene oxide) as a binder was dissolved previously. To this suspension, yttrium acetate was added to be 1.5 wt % in terms of oxide concentration with respect to the fluorescent fine particles, and dissolved by stirring. Furthermore, acetic acid was introduced into this suspension to adjust the pH in a range from 5.5 to 7, and the suspension was passed through a mesh so as to improve the dispersibility and also to remove agglomerates, dust or the like.

This phosphor suspension was coated on an inner surface of a glass bulb 26 mm in tube diameter and 1200 mm in length. The coating onto the glass bulb was performed by pouring the solution into the bulb from above. In this example, a base protective film comprising $Al_2O_3$ fine particles was formed previously on the inner surface of the glass bulb. This protective film was formed by pouring from above an aqueous dispersion of the $Al_2O_3$ fine particles.

Subsequently, the coated layer was dried using hot air at 90° C. The drying time was about 3 minutes. Furthermore, firing was carried out in a gas furnace at a predetermined temperature of 780° C. The firing time was 3 minutes. Then, exhausting the glass bulb, filling of a gas (Ar), and sealing of the bulb were carried out to provide a 40 W straight tube type fluorescent lamp (e).

Comparative Example 3

For comparison, a fluorescent lamp (f) was manufactured in the same manner as described in Example 3 except that yttrium acetate was not added to the phosphor suspension.

Figure 11:
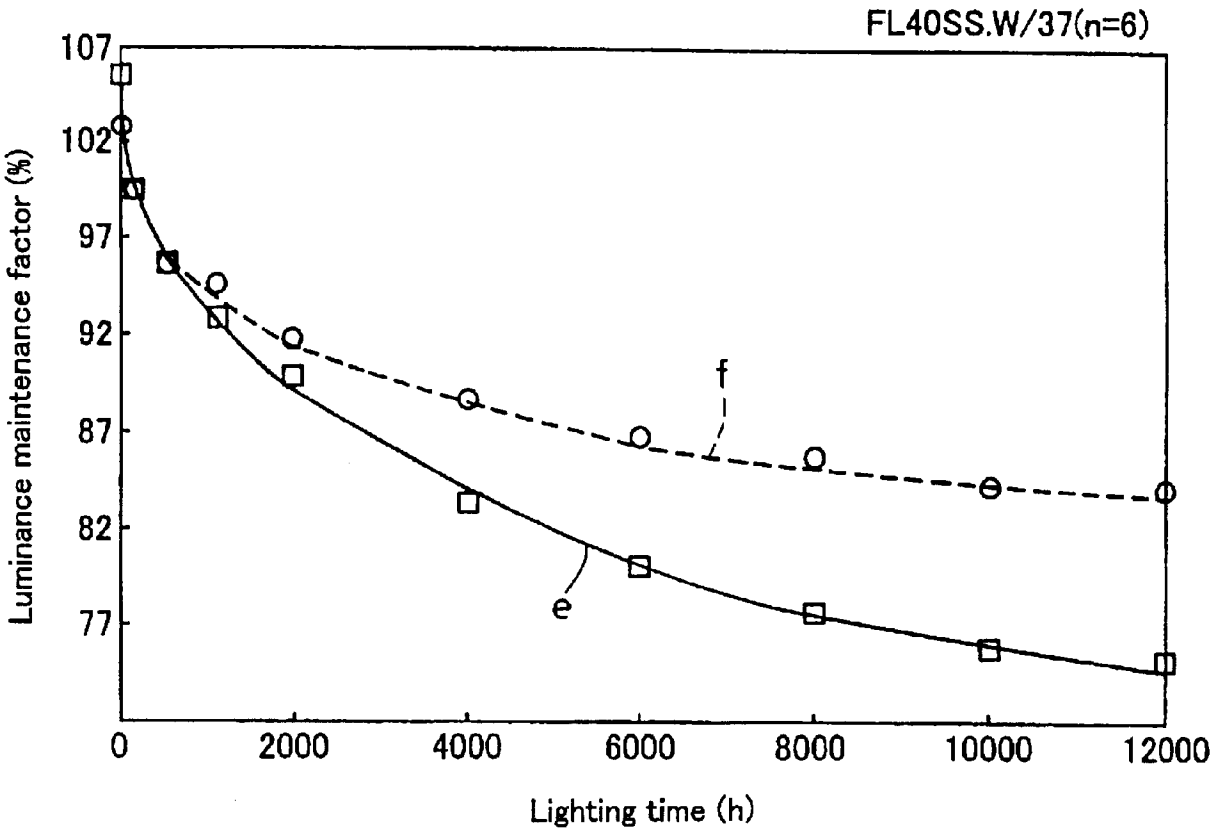
FIG. 11 shows luminous maintenance factors for a fluorescent lamp 'e' according to the present invention and for a conventional fluorescent lamp 'f'.

Luminous maintenance factors were measured for the fluorescent lamp (e) obtained in Example 3 and for the fluorescent lamp (f) obtained in Comparative Example 3. The results are shown in FIG. 11. The lighting frequency and the supply source voltage were fixed at 45 KHz and 256 V, respectively. It was confirmed from FIG. 11 that deterioration of luminance was prevented further in the fluorescent lamp (e) having yttrium oxide formed among the phosphor particles than in the fluorescent lamp (f). Here, luminance after 100 hours from the start of lighting was determined as 100%.

Figure 12:
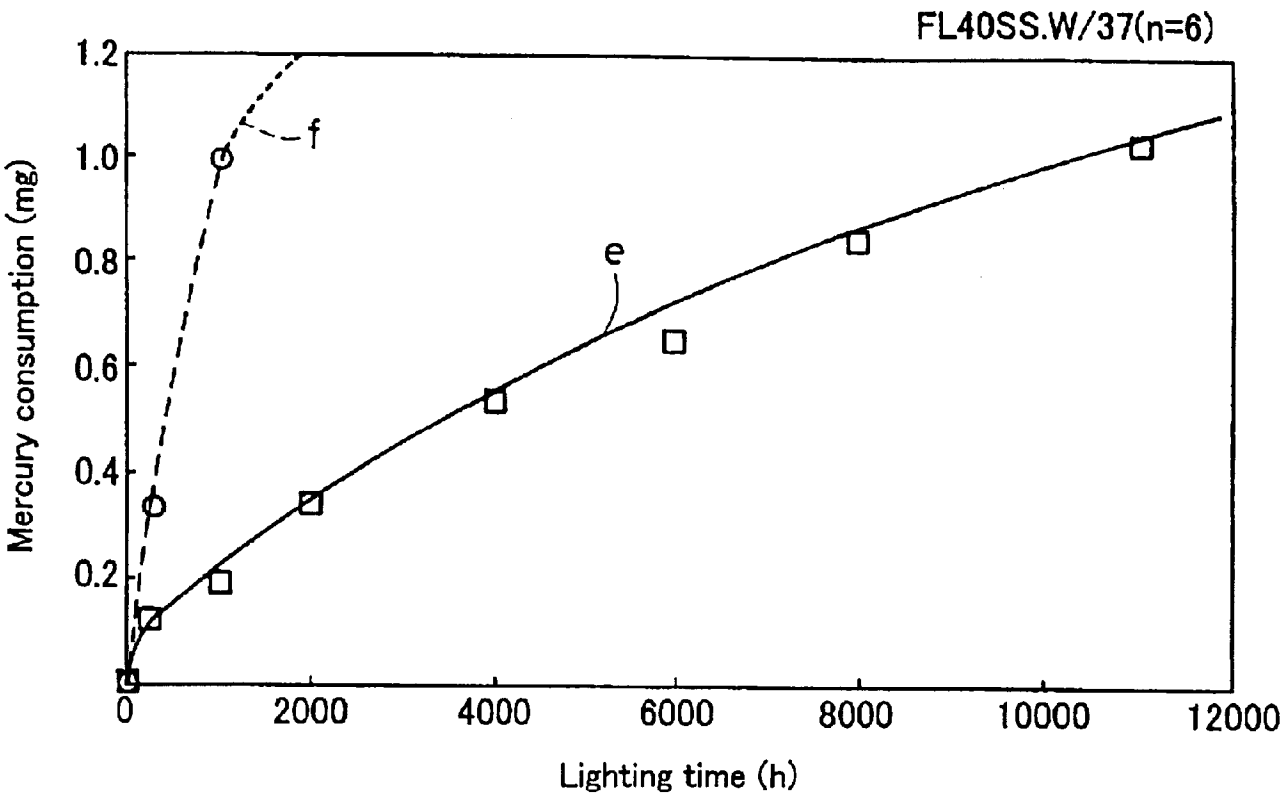
FIG. 12 shows mercury consumption rates for a fluorescent lamp 'e' according to the present invention and for a conventional fluorescent lamp 'f'.

Furthermore, mercury consumption rates were measured for the fluorescent lamp (e) and for the fluorescent lamp (f). The mercury consumption rates were obtained by turning the lamps on at a direct current of 200 V and measuring the time until a cataphoretic phenomenon occurred. The amount of mercury filled in the bulb was 1 mg±0.1 mg glass capsules. The results are shown in FIG. 12.

Comparative Example 4

In this Comparative Example, a phosphor layer including phosphor particles entirely coated with metal oxide layers was formed. The coating of the entire surfaces of the phosphor particles was carried out by adding an appropriate amount of the phosphor particles in an aqueous solution of yttrium acetate, and further adding aqueous ammonia to precipitate yttrium hydroxide. The thus coated phosphor particles were filtered and then fired. A fluorescent lamp using the phosphor particles had an initial flux that was lower by as much as 34% than that of the fluorescent lamp (e) manufactured in Example 3.

Example 4

Preferred conditions for manufacture were examined by using a fluorescent lamp manufactured in a manner as described in the above Examples.

First, temperatures for firing a phosphor was examined. A phosphor-layer-forming solution used for this purpose was prepared by dissolving yttrium carboxylate in butyl acetate.

In a step of forming a phosphor layer (step of baking a phosphor), an yttrium compound is decomposed thermally in order to form yttrium oxide on the surfaces of or among the phosphor particles. However, insufficient firing can degrade the initial luminance or considerably degrade the luminance maintenance factor.

Figure 14A:
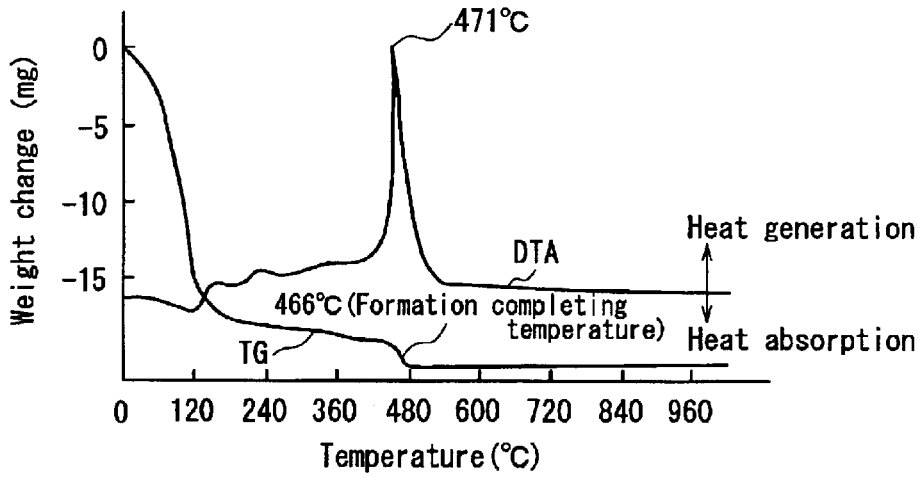
FIG. 14 shows a pyrolytic property of yttrium carboxylate.
Figure 14B:
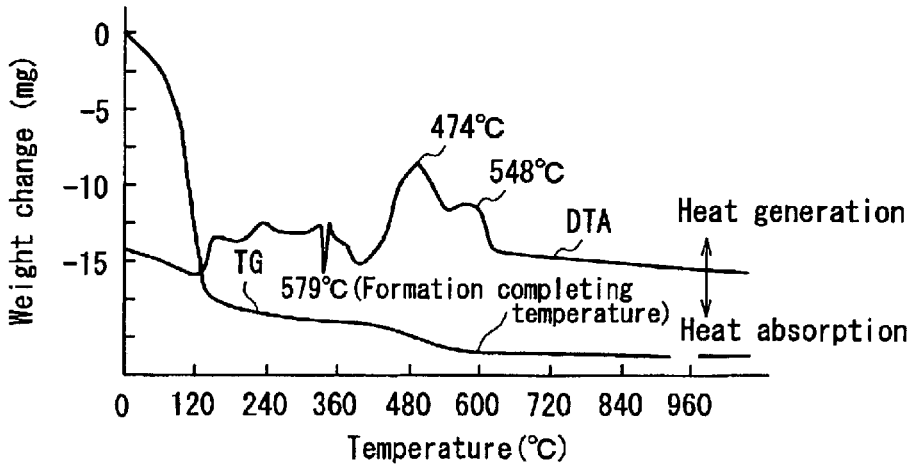

FIGS. 14(*a*) and (*b*) show results of thermal analyses (TG/DTA) on a butyl acetate solution of yttrium carboxylate. In FIG. 14(*a*), the measuring conditions included an air supply of 100 ml/min.·g into the glass bulb, air as the atmosphere, and the warm-up rate of 10° C./min. The measuring conditions in FIG. 14(*b*) were the same as those in FIG. 14(*a*) except that the air supply was omitted. The air supply amount is indicated as a converted value for 1 g of the phosphor layer (hereinafter, the same).

As indicated in the DTA curve in FIG. 14(*a*), the thermal decomposition proceeded rapidly at 471° C. when air was supplied. It was indicated from the weight saturation level of the TG curve that a temperature for completing formation of yttrium oxide was about 466° C.

For the DTA curve in FIG. 14(*b*), the decomposition reaction of the yttrium oxide shifted to a high temperature side of 474° C. and 548° C. when there was no air supply. The weight saturation level of the TG curve indicated that the temperature for completing the formation also shifted to a high temperature side of 579° C. In a similar thermal analytic measurement performed in nitrogen, yttrium carboxylate was not decomposed thermally even when being heated to 1000° C.

It will be difficult to supply oxygen into a thin tube (inner diameter: 4 mm or less, e.g., about from 3 mm to 1.4 mm) of a glass bulb in a cold-cathode fluorescent lamp. Therefore, the temperature for baking a phosphor was required to be high in conventional techniques. A glass bulb configured as a thin tube comprises borosilicate glass having a high softening temperature. Even a bulb of borosilicate glass will be softened when it is heated at a temperature higher than 880° C. For this reason, it is impossible in conventional techniques to sufficiently fire a phosphor layer in tubes. A step of baking a phosphor with a supply of an oxygen-containing-gas such as air is suitable for a glass bulb having a thin tube.

Figure 15:
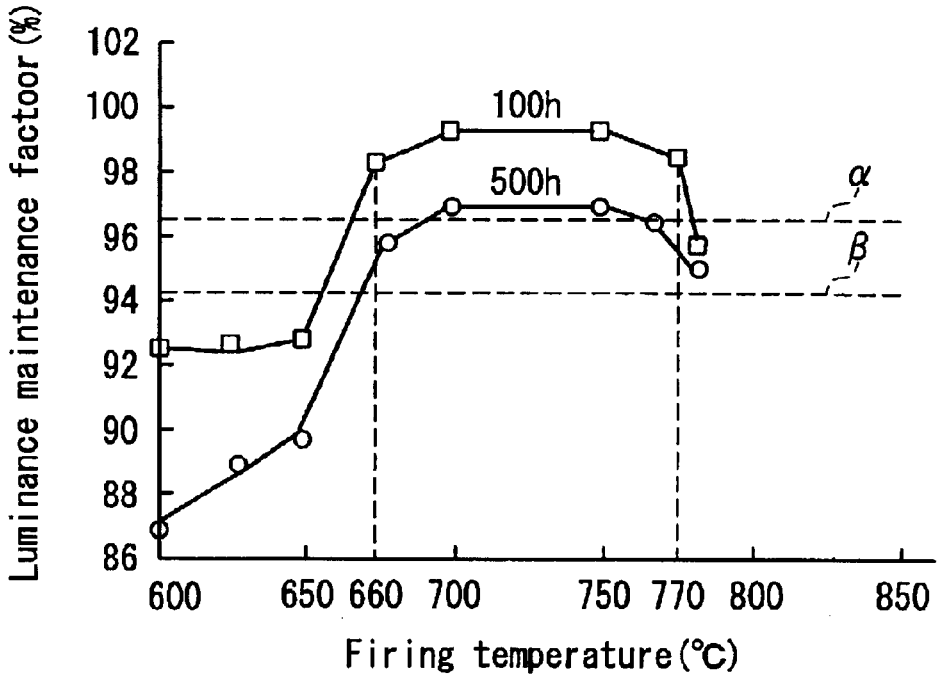
FIG. 15 shows an example of relationships between a firing temperature (measured in a bulb) and a luminance maintenance factor, and a difference in the relationships depending on the lighting time.

FIG. 15 shows a result of examination about a luminance maintenance factor (lighting time: 100 hours and 500 hours) in firing a phosphor with a supply of air while varying the baking temperatures (measured in the glass bulb) (600° C., 650° C., 700° C., 750° C., and 780° C.). A dashed line a indicates a luminance maintenance factor over a lighting time of 100 hours for a lamp that did not contain any metal oxides and was manufactured in a method of current technology. Similarly, a dashed line β indicates a luminance maintenance factor over a lighting time of 500 hours for a lamp that was manufactured in a method of the current technology. These dashed lines and also a dashed line y described below show peak levels of luminance maintenance factors in current technology. The time for firing the phosphor was set at a practical level of 5 minutes. The air supply condition was adjusted to be 125 ml/min.·g based on a measurement of the flow rate in the tube.

The optimum condition was obtained from a luminance maintenance factor at points of 100 hours and 500 hours during lighting of the lamp as an experimental product. The lamp luminance was measured using a color luminance meter. The luminance maintenance factor was calculated by determining the initial luminance as 100%.

A cold-cathode fluorescent lamp (n=3) used here was made of borosilicate glass, 2.6 mm in outer diameter (2.0 mm in inner diameter) and 300 mm in total length. The lamp was evaluated by lighting at a constant lamp current of 6 mA. The phosphor was a three-color wavelength type phosphor (red:$Y_2O_3$:Eu, green:$LaPO_4$:Ce,Tb, blue:$BaMg_2Al_{16}O_{27}$:Eu), and it was adjusted to have a chromaticity (x, y)=(0.310, 0.295). A phosphor coating weight was determined to be 82+4 mg. The filler gas was Ne/Ar 95/5, and the pressure was 0.01 MPa.

FIG. 15 demonstrates that the luminance maintenance factor was improved remarkably in a temperature range of 660° C. to 770° C. when compared to the current technology. The formation of yttrium oxide becomes insufficient at a baking temperature lower than 660° C., while crystallization of the yttrium oxide will proceed at a temperature higher than 770° C. Probably, the proceeding crystallization caused deterioration of the barrier effect of mercury.

Figure 16:
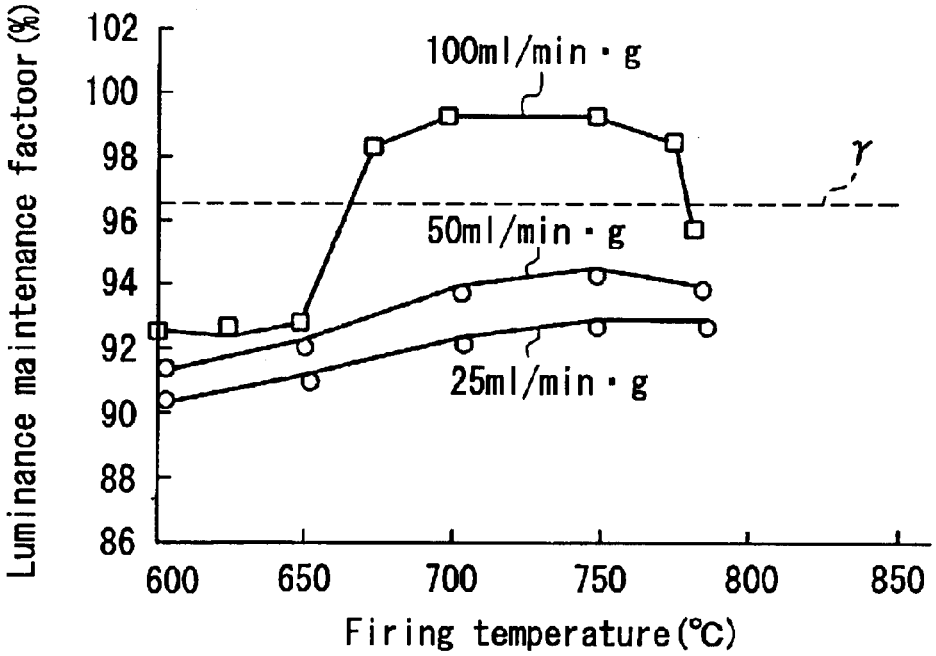
FIG. 16 shows an example of relationships between a firing temperature (measured in a bulb) and a luminance maintenance factor, and a difference in the relationships depending on the air flow rate.

FIG. 16 shows a relationship between a bulb temperature and an amount of air supply when the amount of air supply varied. A dashed line γ indicates a luminance maintenance factor at a point of 100 hours of a product that did not contain any metal oxides and was manufactured in the current manufacturing method. It was confirmed from the result of FIG. 16 that preferably the amount of air supply is at least 100 ml/min.·g.

The following description is about molecular weights of metal oxides according to the present invention.

Example 5

Preferred manufacturing conditions were examined in this example, using a fluorescent lamp manufactured in a manner as described in the above Examples.

Here, a molecular weight of the metal oxide was examined. Specifically, a level of moisture-removal provided by a short-time firing (about 5 minutes) was checked. More specifically, yttrium oxides were formed by using yttrium compounds with varied molecular weights in order to evaluate residual moisture in the oxides. The residual moisture was evaluated on the basis of a level of absorbance in an OH group absorption band (4300 $cm^{-1}$), using a FT-IR spectroscopic analyzer.

Figure 17:
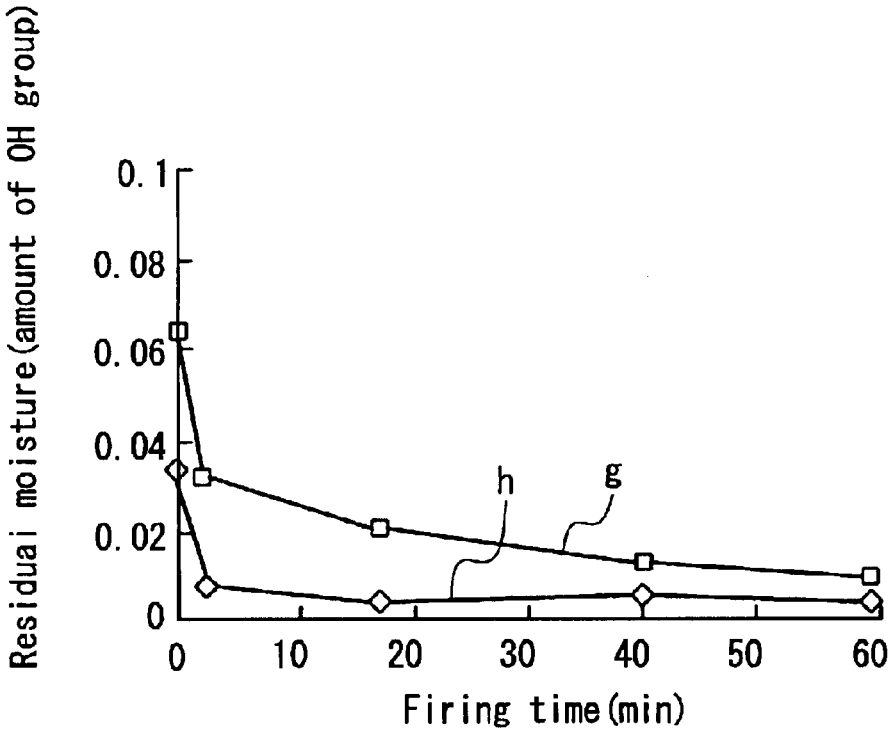
FIG. 17 shows an example of relationships between a firing time and residual moisture, and a difference in the relationships depending on a molecular weight of yttrium carboxylate.

FIG. 17 shows relationships between a firing time and a residual moisture for yttrium carboxylate. A curve 'g' and a curve 'h' denote respectively yttrium acetate having a functional group of a molecular weight of 59 and yttrium carboxylate having a functional group of a molecular weight of 101. These compounds were dissolved respectively in butyl acetate. The compounds were spin-coated to have a thickness of 0.1 μm on a silicon wafer, and dried at 100° C. for 30 minutes. Later, the residual moisture that varied depending on the firing time was examined at a firing temperature of 550° C.

The curve 'g' indicates that moisture was removed by firing for about 60 minutes when the molecular weight of the functional group was 59, but that moisture was not removed by firing for about 5 minutes or a practical time level for the purpose of firing. The curve 'h' indicates that moisture was removed in a short time of about 5 minutes when the molecular weight of the functional group was 101. The result of FIG. 17 demonstrates that formation of steric hindrance in a Y atom serves to suppress attacks of an OH group, and thus the residual moisture can be reduced.

Figure 18:
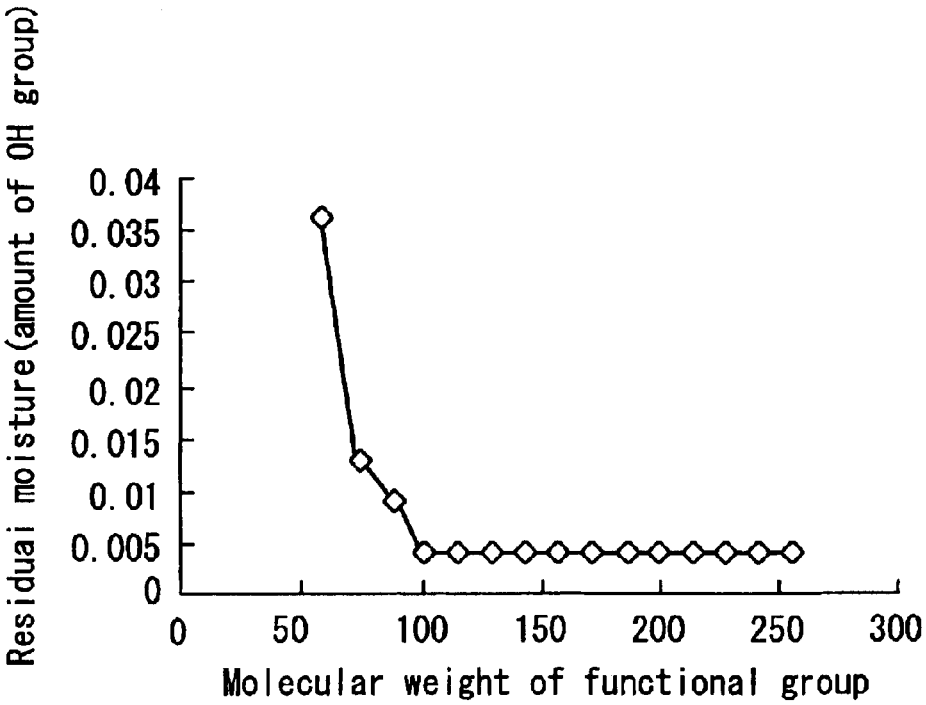
FIG. 18 shows a relationship between a molecular weight of a functional group and residual moisture for yttrium carboxylate.

The following description is an example according to the present invention, where the molecular weight of a functional group is optimized using a similar experimental method. The inventors studied a linear saturated carboxyl group represented by a chemical formula: $C_nH_{2n+1}COO$—, by varying 'n'. Yttrium carboxylate is represented as $Y(OCOC_nH_{2n+1})_3$. FIG. 18 shows a result of an examination about a relationship between residual moisture and the varying molecular weight of the functional group. The firing time was 5 minutes.

Figure 19:
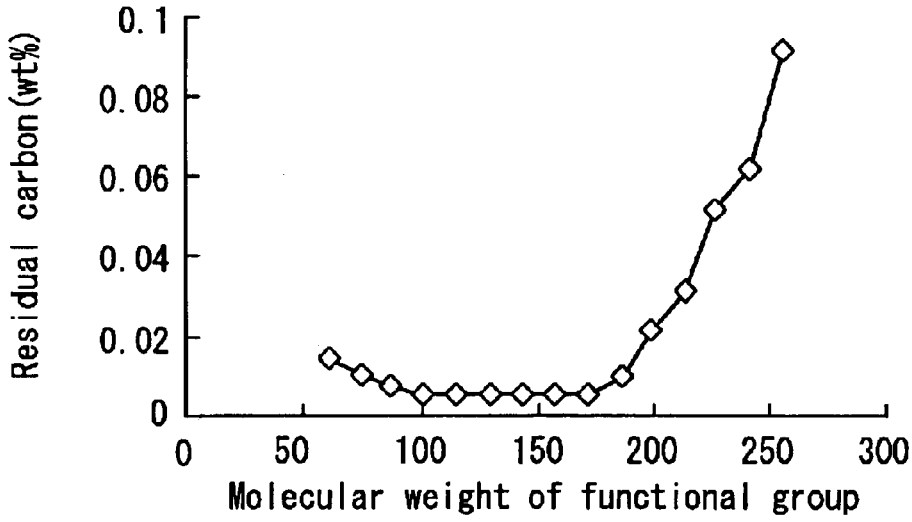
FIG. 19 shows a relationship between a molecular weight of a functional group and residual carbon for yttrium carboxylate.

FIG. 19 shows a result of an examination on a relationship between the molecular weight and residual carbon. Measurement of residual carbon was carried out using a carbon analyzer (produced by Shimadzu Corporation) based on an infrared absorption method. FIGS. 18 and 19 show that the amounts of residual carbon and moisture are reduced when the molecular weight of the functional group is in a range from 73 to 185. The best range for the molecular weight was from 101 to 143.

Though an yttrium carboxylate compound was referred to this example, there is a similar tendency in a molecular weight of a functional group with regard to yttrium alkoxide having an additional alkoxyl group (chemical formula: $C_nH_{2n+1}O$—) and an olefin-based yttrium compound.

Example 6

Figure 20:
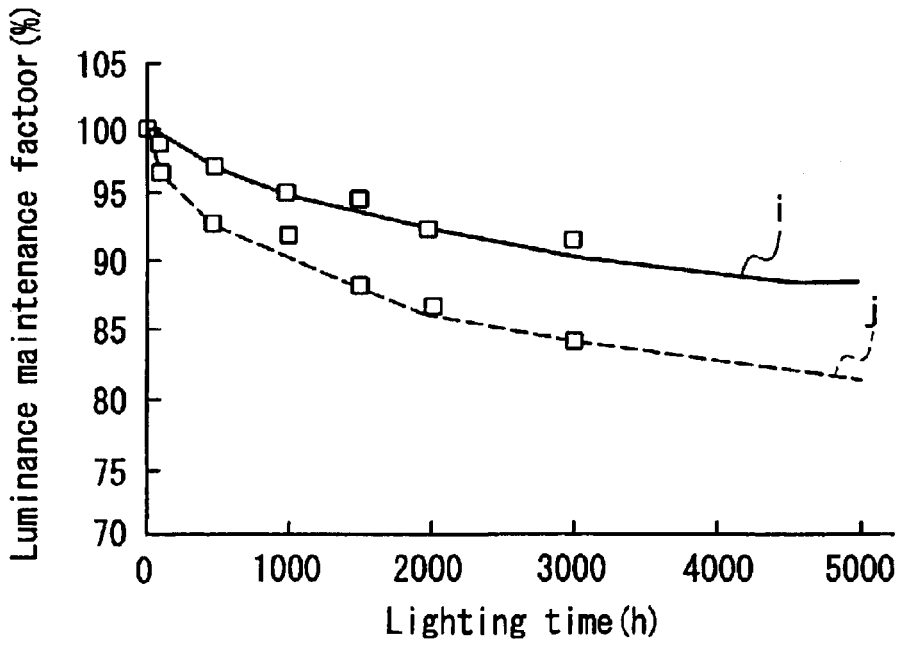
FIG. 20 shows luminous maintenance factors for a fluorescent lamp 'i' according to the present invention and for a conventional fluorescent lamp 'j'.
Figure 21:
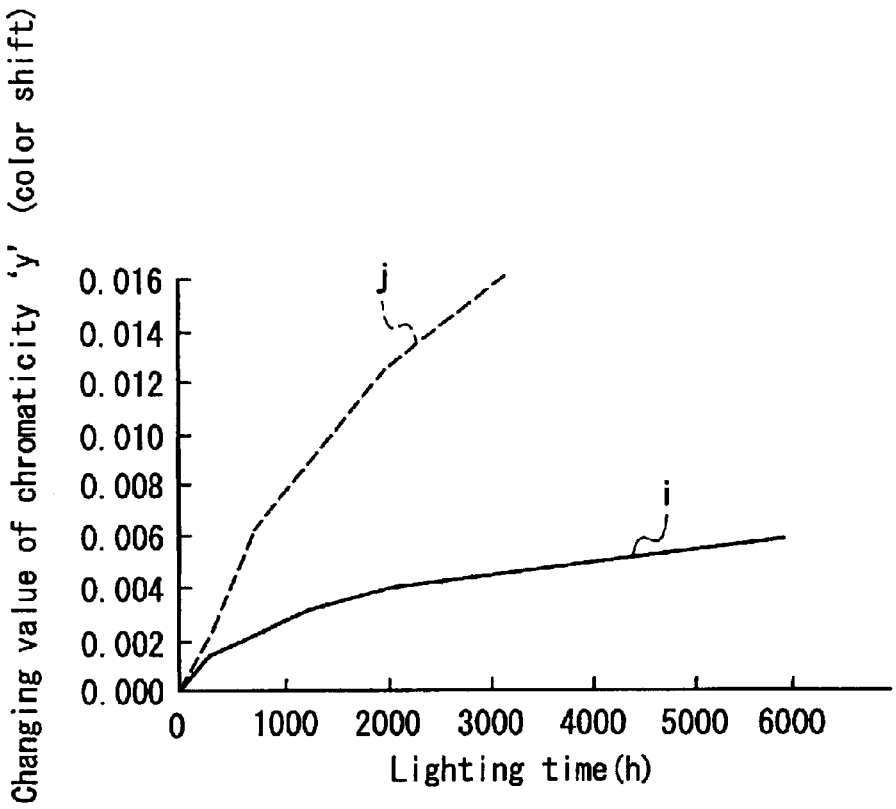
FIG. 21 shows changing values of chromaticity 'y' for a fluorescent lamp 'i' according to the present invention and for a conventional fluorescent lamp J.

FIG. 20 shows a relationship between a lighting time and a luminance maintenance factor for another cold-cathode fluorescent lamp according to the present invention. A curve 'i' denotes a lamp containing yttrium oxide and a curve 'j' denotes a lamp without this oxide. FIG. 21 shows relationships between lighting times and change (color shift) of 'y' values on the chromaticity coordinate with respect to the initial values.

A cold-cathode fluorescent lamp was made of borosilicate glass, 2.6 mm in outer diameter (2.0 mm in inner diameter) and 300 mm in total length. This lamp was lighted at a fixed lamp current of 6 mA for evaluating its properties.

The phosphor was a three-color wavelength type phosphor (red:$Y_2O_3$:Eu, green:$LaPO_4$:Ce,Tb, blue:$BaMg_2Al_{16}O_{27}$:Eu), and it was adjusted to have a chromaticity (x, y)=(0.310, 0.295). A phosphor coating weight was 82±4 mg. The filler gas was Ne/Ar=95/5, and the pressure was 0.01 MPa.

Application of the present invention is not limited to cold-cathode fluorescent lamps but the present invention can be applied also to hot-cathode fluorescent lamps, compact fluorescent lamps such as bulb-type fluorescent lamps, and electrodeless fluorescent lamps using external dielectric coils. The metal oxide is not limited to Y but any of the above-described elements can be used similarly.

Example 7

Figure 23:
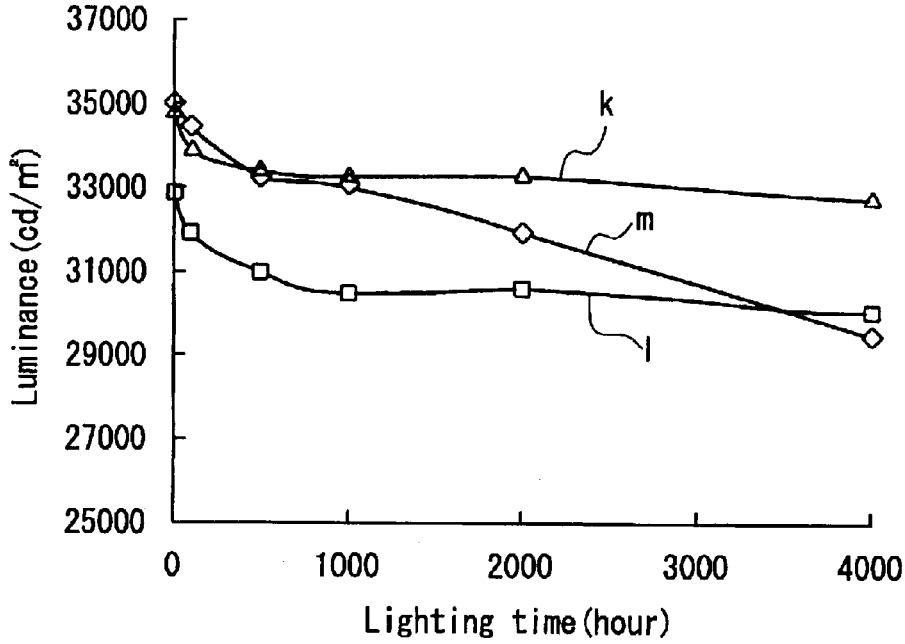
FIG. 23 shows changes in luminance of the lamp according to an amount of the metal oxide.

A fluorescent lamp 'k' was manufactured in the same manner as described in Example 1 except that the amount of the metal compound (yttrium oxalate) to be added was changed from 1.5 wt % to 0.05 wt % (concentration in terms of metal oxide). Similarly, a fluorescent lamp 'l' was manufactured in the same manner as the case of the fluorescent lamp 'k' except that the amount of the metal compound to be added was changed to 1.5 wt %. Furthermore, a fluorescent lamp 'm' was manufactured in the same manner as the case of the fluorescent lamp 'k' except that any metal compounds were not added. Then, the change in the luminance for the fluorescent lamps 'k'-'m' were measured. The results are shown in FIG. 23.

The fluorescent lamp 'k' containing a metal oxide in an amount of 0.01 wt % to 0.6 wt % with respect to the phosphor particles provides initial luminance substantially equivalent to that of the lamp 'm' containing no metal oxide, and furthermore, deterioration of this luminance is suppressed.

As described above, the present invention can provide a fluorescent lamp with suppressed deterioration of the luminance. It should be noted specifically that the present invention can suppress deterioration of the luminance while maintaining other properties such as the initial flux and the film strength.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, all changes that come within the meaning and range of equivalency of the claims are intended to be embraced therein.

What is claimed is:

1. A fluorescent lamp comprising a translucent container and a phosphor layer formed on an inner surface of the translucent container, wherein the phosphor layer comprises phosphor particles and a metal oxide that is arranged to adhere to any of contact portions among the phosphor particles and to partially expose surfaces of the phosphor particles.

2. The fluorescent lamp according to claim 1, wherein the metal oxide covers 1% to 70% of the surfaces of the phosphor particles.

3. The fluorescent lamp according to claim 1, wherein the phosphor layer is substantially free of non-phosphor particles that are at most 0.5 $\mu$m in particle diameter.

4. The fluorescent lamp according to claim 1, wherein the metal oxide comprises at least one element selected from the group consisting of Y, La, Hf, Mg, Si, Al, P, B, V and Zr.

5. The fluorescent lamp according to claim 4, wherein the metal oxide comprises at least one element selected from the group consisting of Y and La.

6. The fluorescent lamp according to claim 1, wherein the metal oxide comprises a metal having a bond energy to an oxygen atom of more than $10.7\times10^{-9}$ J.

7. The fluorescent lamp according to claim 1, wherein the translucent container is a glass tube having an inner diameter ranging from 1.0 mm to 4 mm.

8. A method for manufacturing a fluorescent lamp, comprising:

coating on an inner surface of a translucent container a phosphor-layer-forming solution in which phosphor particles are dispersed and a metal compound is dissolved, and heating the translucent container coated with the phosphor-layer-forming solution so as to form a metal oxide from the metal compound, thereby forming a phosphor layer comprising the metal oxide and the phosphor particles.

9. The method according to claim 8, further comprising drying at least part of a solvent contained in the phosphor-layer-forming solution that is supplied onto the inner surface of the translucent container, whereby the metal compound is concentrated at contact portions among the phosphor particles, before heating the translucent container.

10. The method according to claim 8, wherein the translucent container is heated while an oxygen-containing gas is supplied into the translucent container.

11. The method according to claim 10, wherein at least 100 ml/minute of air as the oxygen-containing gas is supplied per gram of the phosphor layer.

12. The method according to claim 10, wherein the translucent container is heated to be from 660° C. to 770° C.

13. The method according to claim 8, wherein the metal compound is an organic metal compound.

14. The method according to claim 13, wherein the organic metal compound comprises at least one group selected from the group consisting of a carboxyl group and an alkoxyl group.

15. The method according to claim 13, wherein the organic metal compound comprises a functional group bonding to a metal atom, and the functional group has a molecular weight ranging from 73 to 185.

16. The method according to claim 8, wherein the phosphor-layer-forming solution comprises an organic solvent.

17. The method according to claim 8, wherein the phosphor-layer-forming solution contains water.

18. The method according to claim 17, wherein the metal compound is yttrium acetate.

19. The method according to claim 8, wherein the phosphor-layer-forming solution comprises the metal compound in a range from 1 weight % to 15 weight % in terms of metal oxide with respect to the phosphor particles.

20. The method according to claim 8, wherein the phosphor-layer-forming solution is substantially free of non-phosphor particles that are at most 0.5 $\mu$m in particle diameter.

21. An information display apparatus comprising the fluorescent lamp according to claim 1.

22. The fluorescent lamp according to claim 1, wherein a content of the metal oxide is from 0.01 weight % to 0.6 weight % with respect to the phosphor particles.

23. The method according to claim 8, wherein a content of the metal compound is from 0.01 weight % to 0.6 weight % in terms of metal oxide with respect to the phosphor particles.

* * * * *